United States Patent [19]

Lindsey et al.

[11] 4,442,639

[45] Apr. 17, 1984

[54] BUILDING STRUCTURE METHOD

[76] Inventors: Stanley D. Lindsey; Socrates A. Ioannides; Jack R. Horner, all of 3716 Hillsboro Rd., Nashville, Tenn. 37215; William S. Denton, 1317 Bales Dr., Morristown, Tenn. 37814; Donald P. Shell, 8904 Ripon Cir., Knoxville, Tenn. 37923; Hubert Bebb, Rte. 3, Buckhorn Rd., Gatlinburg, Tenn. 37738

[21] Appl. No.: 325,506

[22] Filed: Nov. 27, 1981

[51] Int. Cl.[3] ..... E04B 1/32

[52] U.S. Cl. ..... 52/73; 52/80; 52/236.2; 220/1 B

[58] Field of Search ..... 52/80–83, 52/65, 73, 246, 236.2; 220/1 B, 71, 5 A, 72.1

[56] References Cited

U.S. PATENT DOCUMENTS

| | | | |
|---|---|---|---|
| 2,768,432 | 10/1956 | Hines | 52/81 |
| 3,707,812 | 1/1973 | Roessl | 52/236.2 |
| 3,841,039 | 10/1974 | Farnsworth | 52/73 |
| 3,916,578 | 11/1975 | Forootan | 52/80 |
| 4,049,195 | 9/1977 | Rugenstein | 52/81 |
| 4,067,153 | 1/1978 | Davis | 52/236.2 |
| 4,068,419 | 1/1978 | Decoppet | 52/73 |
| 4,203,805 | 5/1980 | Diggs | 52/80 |

OTHER PUBLICATIONS

Civil Engineering, Oct. 1959, pp. 46–48.

*Primary Examiner*—Henry E. Raduazo

*Attorney, Agent, or Firm*—Pitts, Ruderman & Kesterson

[57] ABSTRACT

A structure and method for producing such a structure of a unique design is disclosed. The structure produced by the features and techniques of this invention comprise a base (16) which is typically supported by the earth (18). The base (16) supports a vertical core structure (14) which extends from the base to a top end. A tension ring (24) is fixedly attached to the top end of the core structure (14). In addition, a compression ring (22) is fixedly attached to the core structure (14). A multiplicity of curved meridian members (26), (28), (30) and (32), extend between the tension ring (24), and the compression ring (22) are of a single selected shape and are circumferentially shaped around the tension ring (24) and the compression ring (22). A multiplicity of radial members (62 through 68) extend horizontal between the core structure (14) and the curved meridian members (26 through 32) and provide structural support for floors and ceilings separating various building levels. In addition, there is a multiplicity of circular hoop members (54 through 60) which provide structural support to the meridian members (26 through 32) to prevent buckling and deformation. Thus, there is provided by this invention a technique for building structures wherein a horizontal cross-section at any vertical location of the three dimensional structure defines a circle.

9 Claims, 10 Drawing Figures

BUILDING STRUCTURE METHOD

DESCRIPTION

TECHNICAL FIELD

This invention relates to building structural designs and more particularly to a method of construction for providing a building of an unusual shape. This method is particularly applicable to the design of any type of building wherein a horizontal cross-section of the building taken at any vertical location will define a circle. This technique is particularly suited for uniquely shaped and modern contemporary buildings, buildings of spherical or near spherical design, or wherein portions of the building are spherical or near spherical design.

BACKGROUND ART

It will be appreciated that, in this period of innovation, there have been a great number of new building designs and structures. Of particular importance recently has been the more spherical or quasi-spherical designs which often use of the geodesic design to produce buildings which have a spherical or quasi-spherical appearance. In this regard, there are many buildings which have a resulting hemispherical design. For example, there is a method of producing a semi-spherical building by means of a process which begins with the construction of a round foundation to which an air form is attached. The air form is inflated, and polyurethane is sprayed on the interior surface. Finally, concrete is applied on top of the polyurethane along with certain supports.

In a similar manner, a structure of generally dome shaped for a free form building is disclosed in U.S. Pat. No. 4,144,680 issued to Thomas L. Kelley on Mar. 20, 1979. According to this patent, a structure which is generally dome shaped is formed by a supporting frame work of circumferentially shaped vertical members and laterally extending members on each side. The inside shell is formed by any suitable manner of concrete mesh and reinforcing members while an outside shell spaced from the inside shell is formed generally similar to the inside shell. The inside and outside shells are connected to and supported by the spaced laterally extending members and provide an air space for insulation.

Thus, it will be appreciated that there have been construction and techniques of providing new building designs. However, as far as large substantially spherical shaped buildings, the process used is typically of the geodetic dome type building or hemispherical concrete buildings. Such processes as will be appreciated by those skilled in the art are extremely complex and consequently expensive.

Therefore, it is an object of the present invention to provide a strong and simple technique for providing buildings having a spherical shape or a shape having substantially spherical portions.

It is still another object of the present invention to provide a method of constructing a building having a spherical portion which avoids the use of cantilevered beams and members, thereby allowing the reduction of support member sizes.

DISCLOSURE OF THE INVENTION

Other objects and advantages will in part be obvious, and will in part appear hereinafter, and will be accomplished by the present invention which provides a method for producing a building or portion of a building having a shape wherein a horizontal cross-section of the building defines a circle. The structure and the method of constructing the building of this invention comprises a base which is supported, for example, by the earth, to which there is firmly and fixedly attached in any known manner a vertical core structure. The core structure extends vertically from the base to a top end. A tension ring is fixedly attached to the vertical core structure between the top end and the base. In most preferred embodiments, the tension ring will be fixedly attached at the top end. In addition, there is also included a compression ring which is fixedly attached to the vertical core structure. In most embodiments, the compression ring is attached at a selected location between the tension ring and the base. A multiplicity of curved meridian members are attached to and extend between the tension ring and the compression ring. This multiplicity of meridian members will all have a single selected shape and are circumferentially spaced around the tension ring and the compression ring. A multiplicity of radial members extend horizontally between, and are attached to both the core structure and the curved meridian members. In a preferred embodiment, there may be several groups of these radial members extending from the core structure and the meridian members such that planar members may be attached thereto to form ceilings and floors. That is, the use of these radial members may be used to provide separation to produce different rooms at different levels in the structure. A multiplicity of horizontal circular hoop members are also attached to the meridian members at selected vertical locations between the tension ring and the compression ring. These circular hoop members greatly strengthen the overall structure by preventing the deformation of the curved meridian members. In addition to structures which use a single tension ring and a single compression ring, other even more complex structures may include additional tension and compression rings. Also, in certain ones of these complex structures, a simple ring may serve as a compression ring to an upper portion of the structure and a tension ring to a lower portion of the structure. Regardless of the number of tension or compression rings, the hoop members and the curved meridian members are all joined such that these members define a three dimensional building structure wherein a horizontal cross-section taken at any selected vertical location through the core structure would define a circle.

BRIEF DESCRIPTION OF THE DRAWINGS

The above-mentioned features of the present invention will be more clearly understood from the consideration of the following description in connection with the accompanying drawings in which.

BEST MODE FOR CARRYING OUT THE INVENTION

Figure 1:
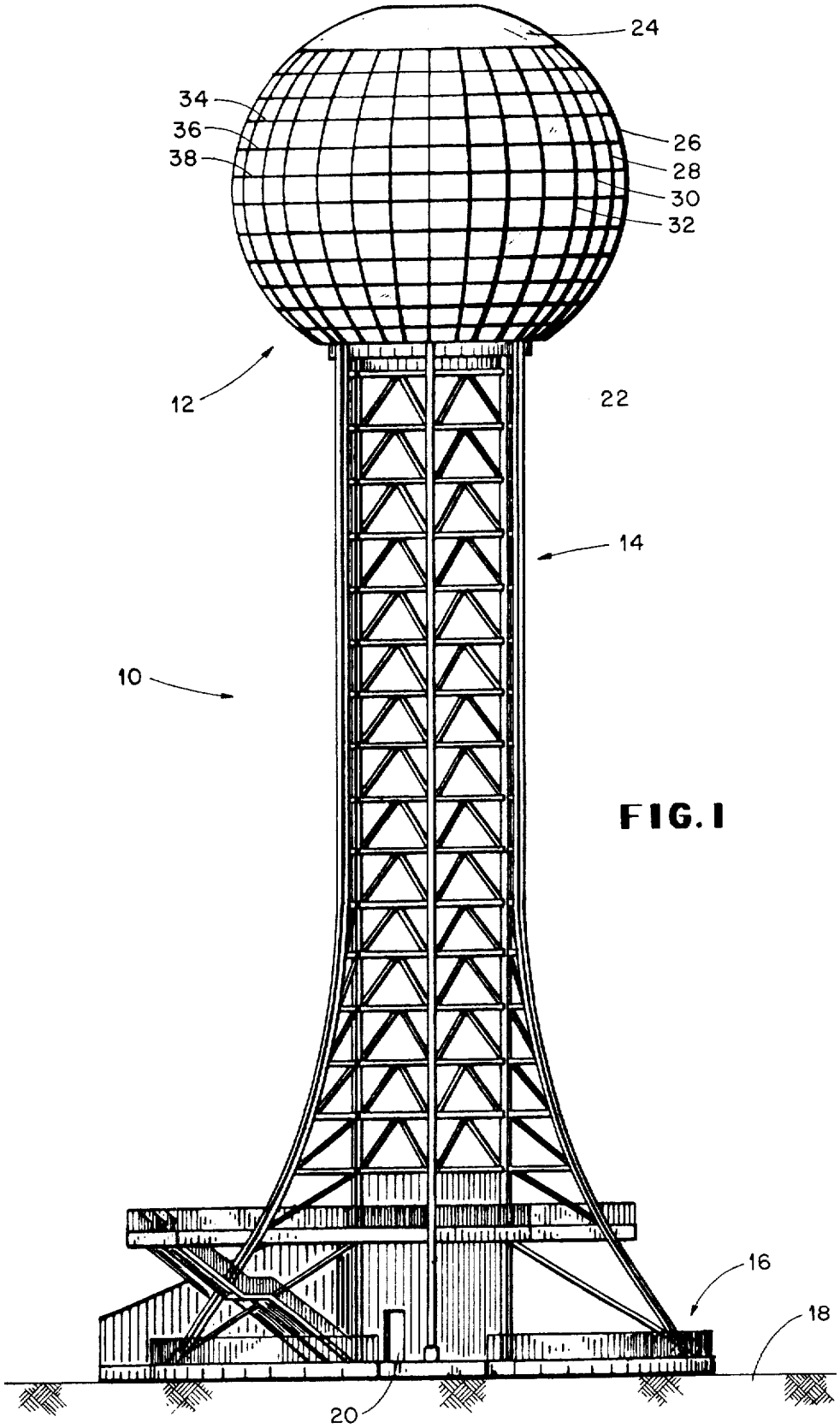
FIG. 1 shows a preferred example of a building constructed in accordance with the technique of this invention.

Referring now to FIG. 1, there is shown generally at 10 a building structure which incorporates the features of the building techniques of this invention. More specifically, the structure shown generally at 10 is a representation of the building which is called Sunsphere building at Knoxville, Tennessee, built for the 1982 World's Fair. As shown, the structure may be considered divided generally into three portions also shown generally which are, the main building structure 12, the core or support structure 14 and the base structure 16. In the embodiment shown, the base structure 16 is, of course, supported by the earth 18. Also as shown, an entry port 20 allows access to the main building structure 12 through the core structure 14. In the Sunsphere building of Knoxville, Tennessee, there are included three elevators (not shown) which extend, of course, through the core structure 14 from the base structure 16 to allow access to the main building structure 12. Also included are emergency stairways. Although the building will be discussed in much more detail hereinafter, it is well to notice that the building structure also includes a compression ring 22 and a tension ring 24. Extending between the tension and compression rings are a multiplicity of meridian members such as 26, 28, 30 and 32. It will be appreciated that only four of these meridian members are shown with referenced numbers and represent only a small portion of the actual number of meridian members. In the particular embodiment of the Sunsphere structure in Knoxville, Tennessee, there are actually thirty of the meridian members used. However, the number of meridian members is not critical and may vary with design and choice. As an example, a design with as few as six meridian members was completed and found to be a sound and stable structure. In addition to the meridian members such as 26, 28, 30 and 32, the FIG. 1 structure also shows the use of the circumferential members such as hoop members 34, 36 and 38. As will be understood hereinafter, these hoop members provide additional strengthening of the building structure. Although the main building structure 12 shown in FIG. 1 has a spherical shape, which is the shape of the Sunsphere building in Knoxville, Tennessee, as will be discussed hereinafter, the building structure is not limited to spheres and may take on any shape wherein a horizontal cross-section of the building structure defines a circle.

For example, FIGS. 2 through 8 show various possible and even whimsical shapes which might effectively use the construction techniques of this invention. As shown for example in FIG. 3, base 40 typically rests on the earth and in turn fixedly supports a core structure 42 which extends from the base 40 to a top portion 44 and which as will be noticed, extends completely through the building structure 45 itself. Attached to this core structure 42 is a top tension ring 46 and the bottom compression ring 48. As was discussed, the meridian members such as 50 and 52 extend between the tension and compression rings. Also shown are the multiplicity of hoop members such as 54, 56, 58, and 60. In a similar manner, the other shapes illustrated by FIGS. 2 through 8 will use similar construction techniques although the meridian members may have a different shape. Although the size and shape of the various structural components may vary with these different structures, the components are similar and consequently carry the same reference numbers of FIG. 3.

Figure 6:
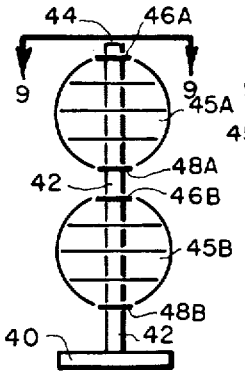

With respect to the many possible shape variations it is important to understand that more than one compression or tension ring may be used. For example, as shown in FIG. 6, two main building structures 45A and 45B may be attached to a single core structure 42. In such a building, there would be a tension ring 46A and a compression ring 48A for building structure 45A, and a tension ring 46B and a compression ring 48B for building structure 45B.

Figure 7:
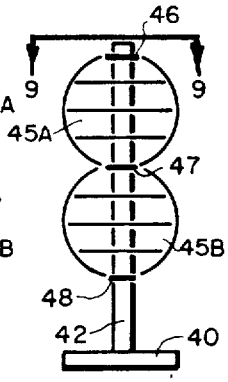

Alternately, as shown in FIG. 7, there may be two building structures 45A and 45B, a single compression ring 48, a single tension ring 46, and a compression/tension ring 47 between building structures 45A and 45B.

Figure 2:
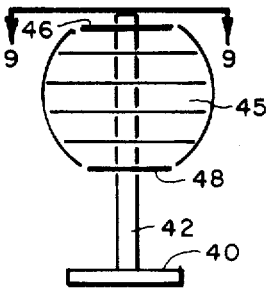
FIGS. 2 through 8 are simplified diagrams of the various type shapes which can be built by the structures and methods of this invention.
Figure 3:
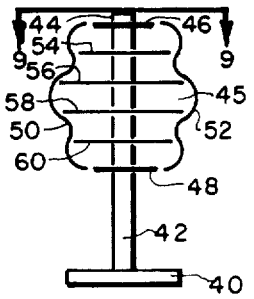
Figure 4:
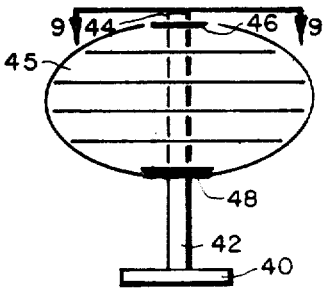
Figure 5:
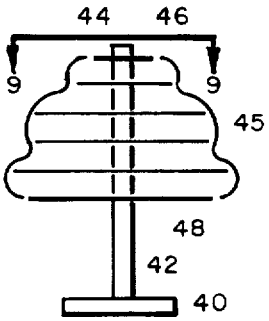
Figure 8:
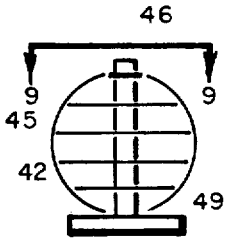

In addition, as shown in FIG. 8, a building 13 similar to that of FIG. 2 may include a single tension ring 46 attached to core structure 42. However, instead of a separate compression ring and base in the design of FIG. 8, the compression ring and the base comprise a single integral structure 49.

Figure 9:
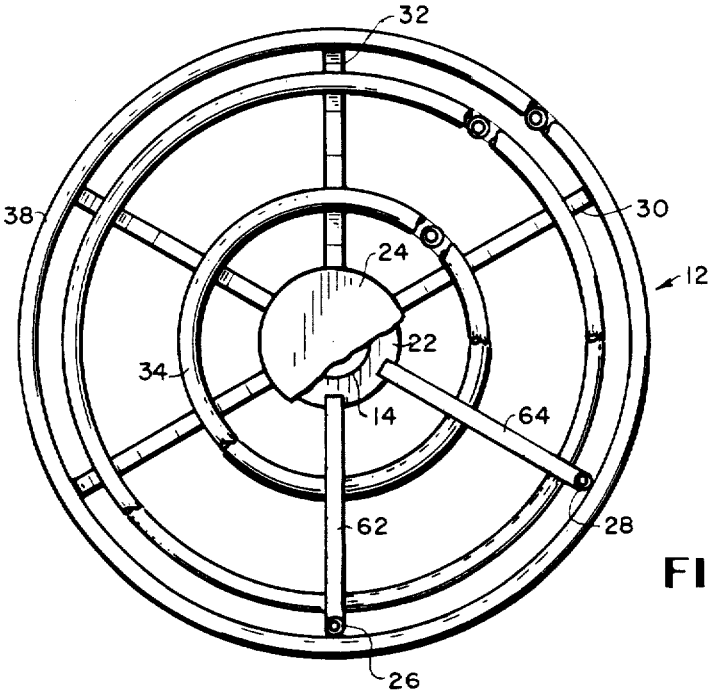
FIG. 9 shows a horizontal partial cross-section which could be taken from any one of FIGS. 2 through 8 to illustrate the circular cross-section which is present with any of the different type of structures built according to the teachings of this invention.

Referring now to FIG. 9, there is shown a horizontal partial cross-section of a main building structure similar to structure 12 of FIG. 1, which could however be from any one of the FIGS. 2 through 8 or any other such shape wherein a horizontal cross-section defines a circle. The only difference in the structures of FIG. 1 and that shown in FIG. 9 is that the structure of FIG. 1 includes thirty meridian members, and the structure of FIG. 9 only has six meridian members. In addition to the meridian members such as 26, 28, 30, and 32, and the hoop members such as 34, 36, and 38 shown in FIG. 8, the structure also includes radial members such as 62, 64, 66 and 68 which extend horizontally from the core structure 14 one each to a meridian member. Only radial members 62 and 64 are visible since the other radial members are hidden by the meridian members. The radial members 62 through 68 are in a group which all extend from the core structure 14 at the same vertical location, such that this portion of the structure is divided into two separate building levels. It will be appreciated, of course, that other groups of horizontal radial members extending from different vertical locations of the core structure 14 would divide the overall spherical main building structure 12 into still other additional building levels. Thus, the radial members will serve as support members for the floor and ceiling between various building levels of the overall three dimension structure. It will, of course, be appreciated that the number of building levels or floors in the main building structure 12 may vary depending upon the size of the structure. If it is assumed that a normal 8 or 10 foot spacing exists between each floor, the number of available floors can readily be determined from the overall vertical dimension of the main building structure 12.

Figure 10:
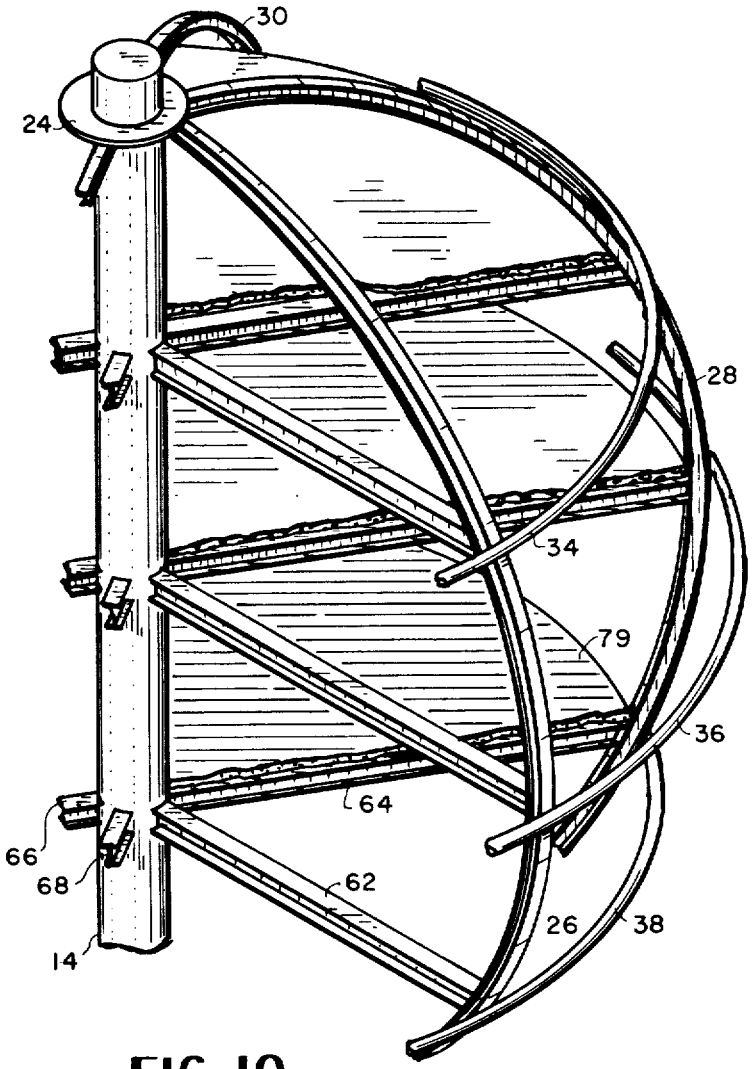
FIG. 10 shows a skeleton perspective of FIG. 2 to illustrate the structural design of a building incorporating the features of the present invention.

As shown in FIG. 10 which is a perspective cross-section of the structure of FIG. 9, there are shown three separate floors. To define each of these floors, three groups of the radial members extend between the core and the meridian members. Each one of the three different groups of radial members will then be used to separate the three dimensional structure into separate building levels.

In a structure of the type shown in the figures, the meridian members which extend between the compression and tension rings provide a unique method of transmitting the loads from the building itself to the central core structure 14 without the use of any cantilevered members. The core structure 14, of course, transmits the loads to the base structure 16 (not shown in FIG. 10). It will also be appreciated that any weight applied to the meridian members such as 28 and 30 through the radial members 64 which support a floor 79 of the building level, imparts tensional forces to the tension ring 24 in both a vertical and radial direction from the meridian members 28 and 30 to the core structure 14. In a similar, but opposite manner, the meridian members impart load stresses to the compression ring (not shown) in a downward and inward direction which in turn imparts these loads to the core structure and the base structure.

Figure 11:
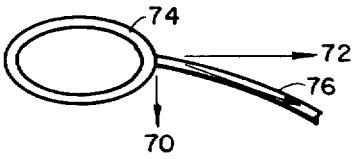
FIGS. 11 and 12 show stress vectors resulting between the compression ring and meridian members and the tension ring and meridian members respectively.
Figure 12:
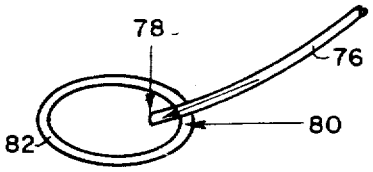

FIG. 11, for example, shows the vertical and horizontal tension forces represented by arrows 70 and 72 respectively experienced and transmitted to the top tension ring 74 from a selected meridian member 76; whereas, FIG. 12 shows the vertical and horizontal compression forces represented by arrows 78 and 80 respectively transmitted from the meridian member 76 to the compression ring 82. Further, although it will be appreciated that a spherical structure may be the strongest of the possible structures incorporating the features of this invention, the FIGS. 3, 4 and 5 also show other structures which may be constructed to incorporate all of the features of this invention, and which because of the unique structure and methods of this invention allow whimsical and unusual designs. The common factor, of course, with all of the structures being that a horizontal cross-section will define a circle. Of particular importance also is the hoop members which relieve stress and provide strengthening to the meridian members to prevent them from buckling or deforming Thus, to this point there have been discussed the general features of a building structure incorporating the features of this invention. Although the invention of the structure shown in FIG. 1 shows the use of thirty meridian members, it will be appreciated that any number of meridian members even so small in number as six or ten will work properly in a structure of this invention and such a number only represents a design choice with respect to the materials and the size of the members chosen. Also, it has been found that in building a structure using these techniques, that meridian members can be of any suitable shape, but that members of a tubular cross-section will normally be the simplest and less expensive to use. Also, of course, the meridian members, radial members, and circumferentially hoop members may be attached one to the other by any suitable technique including welding, bolting or the like.

Thus, although the present invention has been described with respect to specific structures and methods, for providing buildings of unusual design, it is not intended that such specific references be considered as limitations upon the scope of this invention except insofar as is set forth in the following claims.

We claim:

1. A building having a shape wherein horizontal cross-sections of the building define a circle, said building comprising:

a base;

a vertical core structure, said core structure being fixedly and permanently attached to said base and extending vertically to a top end;

a circular tension ring fixedly attached to said vertical core structure proximate said top end of said vertical core structure;

a circular compression ring fixedly attached to said vertical core structure at a location below said tension ring;

a multiplicity of curved meridian members attached to and extending between said tension ring and said compression ring, said multiplicity of meridian members having a single selected shape and being substantially uniformly spaced around said tension ring and said compression ring;

a multiplicity of radial members extending horizontally between and attached to said core structure and said curved meridian members; and a multiplicity of horizontal circular hoop members attached to said multiplicity of meridian members at selected vertical locations between said tension ring and said compression ring, each of said circular hoop members surrounding said core structure, said meridian members and said circular hoop members defining a three dimensional building structure wherein a horizontal cross-section taken at any selected vertical location through said building structure defines a circle.

2. The building of claim 1 wherein at least a portion of said radial members comprise a group of radial members located at a first selected vertical location along said core structure such that said first group of radial members divide said three dimensional building structure into a first building level and a second building level.

3. The building of claim 1 wherein at least a portion of said radial members comprise a multiplicity of groups of radial members, each of said multiplicity of groups being located at a different one of selected vertical levels along said core structure such that said multiplicity of groups of radial members divide said three dimensional building structure into a multiplicity of building levels.

4. The building of claims 2 or 3 further including planar members attached to and extending between radial members of a selected group of said radial members to form a floor of one of said building levels and the ceiling of another adjacent of said building levels.

5. The building of claims 1, 2, or 3 wherein said meridian members have a selected substantially semi-circular shape such that said three dimensional building structure substantially defines a sphere.

6. The building of claim 1 wherein said base and said compression ring are a single integral structure.

7. A multi-floored spherical shaped building wherein horizontal cross-sections of the building define a circle, said building comprising:

a base;

a vertical core structure, said core structure being fixedly and permanently attached to said base and extending vertically to a top end;

a circular tension ring fixedly attached to said vertical core structure proximate said top end of said vertical core structure;

a circular compression ring fixedly attached to said vertical core structure between said tension ring and said base;

a multiplicity of substantially semi-circular meridian members attached to and extending between said tension ring and said compression ring, said multiplicity of meridian members being uniformly spaced around said tension ring and said compression ring;

a multiplicity of radial members extending horizontally between and attached to said core structure and said meridian members;

a multiplicity of circular hoop members attached to said multiplicity of meridian members at selected horizontal locations between said tension ring and said compression ring, each of said circular hoop members surrounding said core structure, said meridian members and said circular hoop members defining a substantially spherical structure above said base, wherein a portion of said radial members comprise a multiplicity of groups of radial members, each of said multiplicity of groups being located at a different one of selected vertical levels along said core structure such that said multiplicity of groups of radial members divide said substantially spherical structure into a multiplicity of building levels; and planar members attached to and extending between radial members of a selected group of said radial members to form a floor of one of said building levels and the ceiling of another adjacent of said building levels.

8. A building having a shape wherein horizontal cross-sections of the building define a circle, said building comprising:

a base;

a vertical core structure, said core structure being fixedly and permanently attached to said base and extending vertically to a top end;

a first circular tension ring fixedly attached to said vertical core structure proximate said top end of said core structure;

a first circular compression ring fixedly attached to said vertical core structure at a location below said first tension ring;

a first multiplicity of curved meridian members attached to and extending between said first tension ring and said first compression ring, said first multiplicity of meridian members having a single selected shape and being substantially uniformly spaced around said first tension ring and said first compression ring;

a multiplicity of radial members extending horizontally between and attached to said core structure and said curved meridian members;

a multiplicity of horizontal circular hoop members attached to said first multiplicity of meridian members at selected vertical locations between said first tension ring and said first compression ring, each of said circular hoop members surrounding said core structure, said meridian members and circular hoop members defining a first three dimensional building structure wherein a horizontal cross-section taken at any selected vertical location through said building structure defines a circle;

a second circular tension ring fixedly attached to said vertical core structure at a location below said first compression ring;

a second circular compression ring fixedly attached to said vertical core structure at a location below said second tension ring;

a second multiplicity of curved meridian members having a selected shape attached to and, extending between, said second tension ring and said second compression ring;

a second multiplicity of radial members extending horizontally between, and attached to, said vertical core structures and said second multiplicity of meridian members; and a second multiplicity of horizontal circular hoop members attached to said second multiplicity of meridian members at selected vertical locations between said second tension ring end said second compression ring, wherein said second multiplicity of meridian members and second multiplicity of hoop members define a second three-dimensional building structure wherein a horizontal cross-section taken at any vertical location through said building structure defines a circle.

9. A building having a shape wherein horizontal cross-sections of the building define a circle, said building comprising:

a base;

a vertical core structure, said core structure being fixedly and permanently attached to said base and extending vertically to a top end;

a circular tension ring fixedly attached to said vertical core structure proximate said top end of said vertical core structure;

a circular combination compression/tension ring fixedly attached to said vertical core structure at a location below said tension ring;

a multiplicity of curved meridian members attached to and extending between said tension ring and said compression/tension ring, said multiplicity of meridian members having a single selected shape and being substantially uniformly spaced around said tension ring and said compression/tension ring;

a multiplicity of radial members extending horizontally between, and attached to, said core structure and said curved meridian members;

a multiplicity of horizontal circular hoop members attached to said multiplicity of meridian members at selected vertical locations between said tension ring and said compression/tension ring, each of said circular hoop members surrounding said core structure, said meridian members and said circular hoop members defining a three dimensional building structure wherein a horizontal cross-section taken at any selected vertical location through said building structure defines a circle;

a compression ring at a location below said combination compression/tension ring, a second multiplicity of curved meridian members having a second selected shape and which are attached to and extend between said combination compression/tension ring and said second compression ring;

a second multiplicity of radial members extending horizontally between, and attached to, said core structure and said second multiplicity of curved meridian members; and a second multiplicity of horizontal circular hoop members attached to said second multiplicity of meridian members at selected vertical locations between said compression/tension ring and said compression ring, each of said second multiplicity of circular hoop members surrounding said core structure, said second multiplicity of meridian members and said second multiplicity of circular hoop members defining a second three dimensional building structure immediately beneath said three dimensional structure wherein a horizontal cross-section taken at any selected vertical location through said building structure defines a circle.

* * * * *